United States Patent [19]

Zagoroff

[11] Patent Number: 4,616,123

[45] **Date of Patent: * Oct. 7, 1986**

[54] SHRINK OVEN

[76] Inventor: Dimiter S. Zagoroff, 10 Hilliard Pl., Cambridge, Mass. 02138

[ * ] Notice: The portion of the term of this patent subsequent to Sep. 3, 2002 has been disclaimed.

[21] Appl. No.: 670,766

[22] Filed: Nov. 13, 1984

[51] Int. Cl.[4] ..... F26B 15/16

[52] U.S. Cl. ..... 219/388; 34/225

[58] Field of Search ..... 219/388; 34/225, 233; 53/442, 557; 432/121, 239, 250, 53, 52

[56] References Cited

U.S. PATENT DOCUMENTS

| | | | |
|---|---|---|---|
| 1,817,810 | 8/1931 | Emerson | 432/53 |
| 2,010,295 | 8/1935 | Dreffein | 432/239 |
| 2,804,855 | 9/1957 | Bergman | 432/250 |
| 2,906,627 | 9/1959 | Payton | 219/388 |
| 3,156,812 | 11/1964 | Forman | 219/388 |
| 3,553,928 | 1/1971 | Baird | 53/30 |
| 3,662,512 | 5/1972 | Zelnick | 53/30 |
| 3,723,708 | 3/1973 | Tulkoff | 219/385 |
| 3,840,997 | 10/1974 | Lucas | 34/66 |
| 3,896,288 | 7/1975 | Tulkoff | 53/30 |
| 3,971,875 | 7/1976 | Regalbuto | 219/390 |
| 4,397,451 | 8/1983 | Kinoshita | 219/388 |
| 4,538,363 | 9/1985 | Zagaroff | 34/225 |

FOREIGN PATENT DOCUMENTS

| | | | |
|---|---|---|---|
| 1586214 | 5/1970 | Fed. Rep. of Germany . | |
| 1761545 | 12/1970 | Fed. Rep. of Germany . | |
| 1561984 | 1/1972 | Fed. Rep. of Germany . | |
| 2117458 | 1/1972 | Fed. Rep. of Germany . | |
| 2844224 | 4/1980 | Fed. Rep. of Germany | 53/557 |
| 268388 | 5/1981 | Fed. Rep. of Germany . | |
| 3117273 | 11/1982 | Fed. Rep. of Germany . | |

OTHER PUBLICATIONS

Engineering Drawing, *Nutro.*

Product Literature, Thimon, 12/83.

*Primary Examiner*—E. A. Goldberg

*Assistant Examiner*—Teresa J. Walberg

[57] ABSTRACT

A shrink oven which limits loss of heated air by controlled movements of the load and the door at the opening through which the load enters or leaves the oven. By automatically stopping the load in a flow-blocking relationship to the opening as it approaches and leaves the opening, and moving the door only when the load is in such a flow-blocking relationship, loss of heated air can be substantially reduced. Preferably further arrangements enable the air volume of the oven to be maintained constant as heated loads are removed and new loads are introduced. In an oven in which loads are introduced through a side entry door, move on a conveyor through the oven, and exit through another door, exiting and entry loads are synchronized in spacing and movement so that the rate of load displacment out of the oven at the exit is compensated by the rate of load displacement into the oven at the entry. Special arrangements prevent hot air loss around the sides of the oven during the exit and introduction phases. These include close-lying passage walls above and on both sides of the doors, for limiting the air conductance of the gaps about the loads. In another oven shown, a boundary wall of the oven, a movable top as shown, moves in synchronism with an entering or leaving load to increase and decrease air volume in opposite effect to that of an entering or exiting load, respectively.

6 Claims, 9 Drawing Figures

SHRINK OVEN

BACKGROUND OF THE INVENTION

This invention is in the field of ovens used for shrink wrapping. A common application of this technique utilizes pre-formed polyethylene bags with a film thickness in the range of 0.002 to 0.012 inches that are put over goods stacked on a pallet. The pallet is then placed in the oven to heat the polyethylene to its shrink temperature in the range of 190 degreees to 300 degrees Fahrenheit. At this temperature the bag shrinks, conforming to the shape of the load and sets up a shrink tension that locks the load securely to itself and to the pallet.

PRIOR ART

A common shrink-oven configuration has side-mounted doors, either on one side only for applications where the pallet enters and exits through the same door, or two sets of doors on opposite sides for a through-flow pallet travel. The most common heating means is by convection. Hot air with a working temperature of 300 to 1000 degrees Fahrenheit is circulated to achieve the desired heat transfer. The oven volume is considerably larger than the volume of the pallet load to provide space over the top and along the sides of the load in which the heated air can circulate.

One drawback of this arrangement is that when the doors are opened, nearly all of the heated air inside the oven spills and is lost to the surroundings. In each cycle the oven thus has to heat not only the film to its shrink temperature but also nearly the whole interior volume of air to its considerably higher working temperature.

The direct heat lost with the air may be equal or larger than the heat transferred into the plastic film.

In addition to the direct heat losses, there are indirect losses attributable, e.g. to (a) the higher heating temperature required to compensate for the influx of a large volume of cold air and (b) the heat losses incurred during the time while the cold air is heated.

The total loss in thermal efficiency is thus greater by a considerable factor than the direct heat loss and becomes even less favorable when the new high-strength, thin films are considered.

Furthermore, the additional heating required has an adverse effect upon cycle time, power rating and utilization of capital equipment and space.

The objects of this invention are to greatly reduce the heat losses mentioned, to decrease cycle time, to decrease the connected or peak heat rating and to achieve greater economy and ease of operation of shrink ovens when taking all costs and factors of convenience and efficiency into account.

SUMMARY OF THE INVENTION

According to one important aspect, the invention provides a shrink oven for heating and shrinking plastic film disposed about a load, the oven having at least one opening for entry or exit of the load, a closure for the opening and conveyor means for conveying the load through the opening between the exterior and the interior of the oven, the oven characterized in having first load position control means operable when the load approaches the opening with the closure closed for stopping the conveyor means to position the load immediately preceding the closure, in a first blocking position to block flow of heated air out of the oven to the exterior, means operable while the load is in this first blocking position to open the closure, second load position control means operable when the load passes through the opening for stopping the conveyor means after the load transits the opening to position the load immediately following the opening in a second blocking position to block flow of heated air out of the oven to the exterior, and means operable while the load is in this second blocking position to close the closure thereby to conserve energy during movement of the load between the exterior and the oven and to enable improvement in the shrink cycle. Preferably, the oven is arranged to operate in this fashion both when the pallet load is introduced to the oven and when it is removed. During the introduction procedure, after the load is in the oven and the closure closed, a third load position control means operates to cause the load to move from its blocking position adjacent the closure to a centered heating position in which all sides of the load are exposed to effective heating.

According to another aspect of the invention, synchronized means during exit and entry of loads are provided to keep the air volume of the oven constant, i.e. to minimize loss even of the heated air displaced by the pallet load. In preferred embodiments, the unwanted escape of hot air is prevented as the load is removed or introduced by simultaneously contracting or expanding the walls to retain the air displaced by the pallet or by synchronizing the movement of an exiting pallet load with one that enters so that there is no net change in the air volume of the oven. With greater particularity, this aspect of the invention features a shrink oven for heating and shrinking plastic film disposed about a succession of loads, and a method for its use, the oven having an opening for relative exit motion of a first load, the oven characterized in having movable means for decreasing the air space within one region of the oven for displacing heated oven air to fill the air space left behind this load as the load exits the oven, a drive for the movable means, and synchronizing means for causing the movable means to move in a manner interdependently with movement of the load, thereby to limit inward flow of air during exit of the load from the oven, whereby conservation of energy and improvement in the shrink cycle can be obtained.

In preferred embodiment, the shrink oven is sized and adapted to receive loads on pallets covered by shrinkable plastic film; the means which compensate for movement of one load out of the oven comprises means to move a second load through an entry opening into the oven, preferably the entry and exit openings being on opposite sides of the oven; conveyor means extend through the oven and means are provided to establish spacing of the loads thereon at a distance corresponding to the distance between the openings; each opening to the oven is associated with means limiting air flow past the sides of the entering or exiting loads; and shrouds are provided on both sides of the entry and exit to limit the air conductance at the top and sides of the loads while the loads reside in an air blocking relationship at the oven openings.

Other preferred embodiments of the invention feature the movable means as a movable oven boundary surface arranged to decrease the enclosed volume of the oven in relation to the rate of increase of air volume in the oven left by the leaving load, the boundary surface being driven in a manner dependent upon movement of the load.

DRAWINGS

FIGS. 1, 1*a*, 1*b*, 1*c* and 1*d* are front views partially in section of an oven featuring synchronization of the positioning of the load and opening and closing of the closure to limit heat loss when the closure is open.

Figure 1:
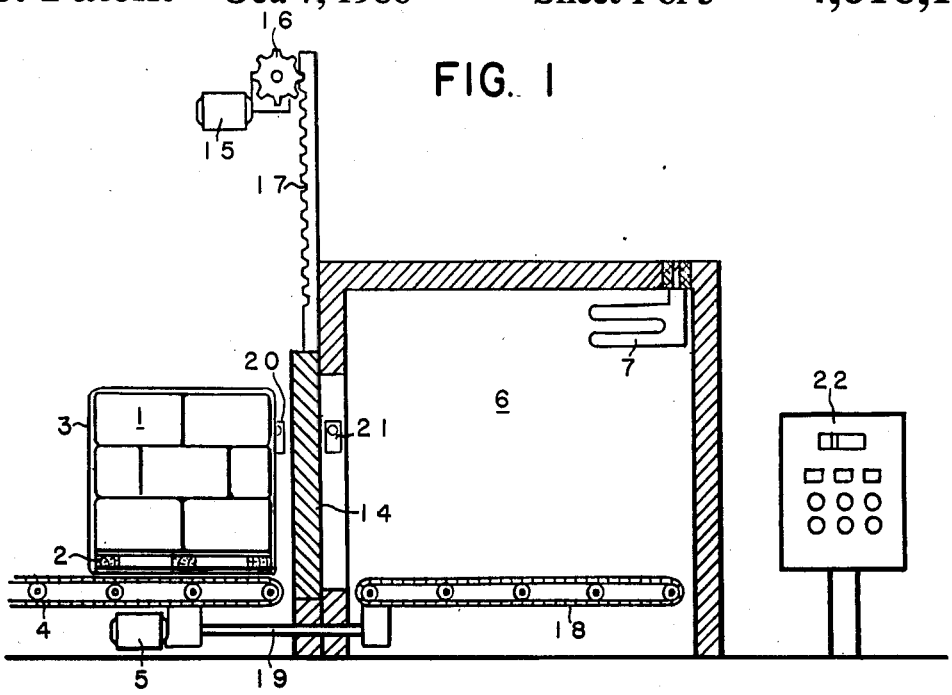
Figure 1A:
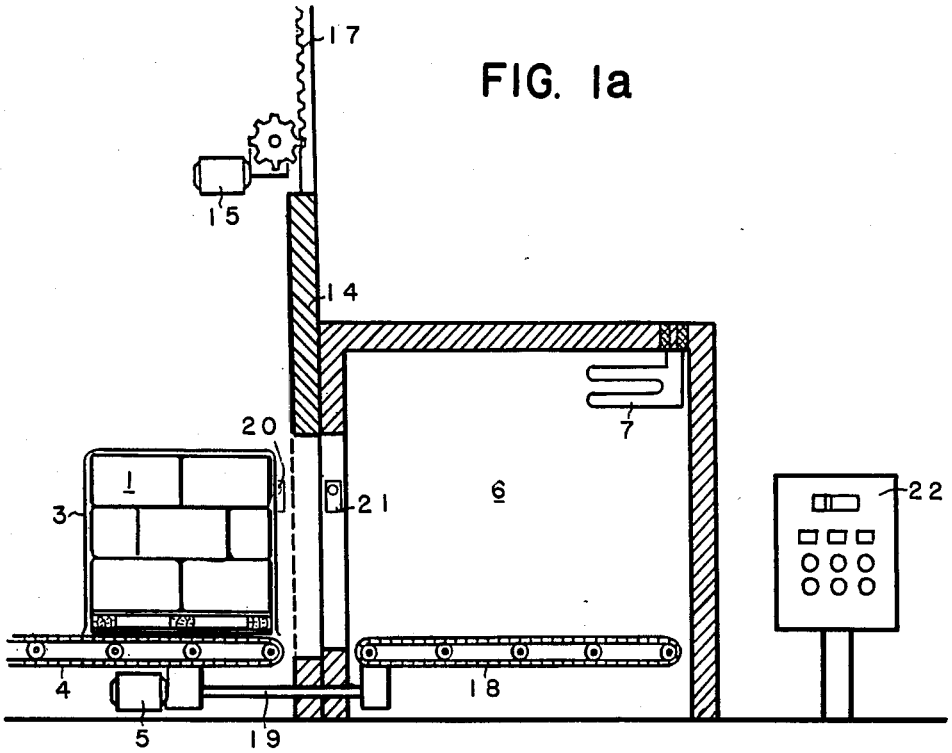
Figure 1B:
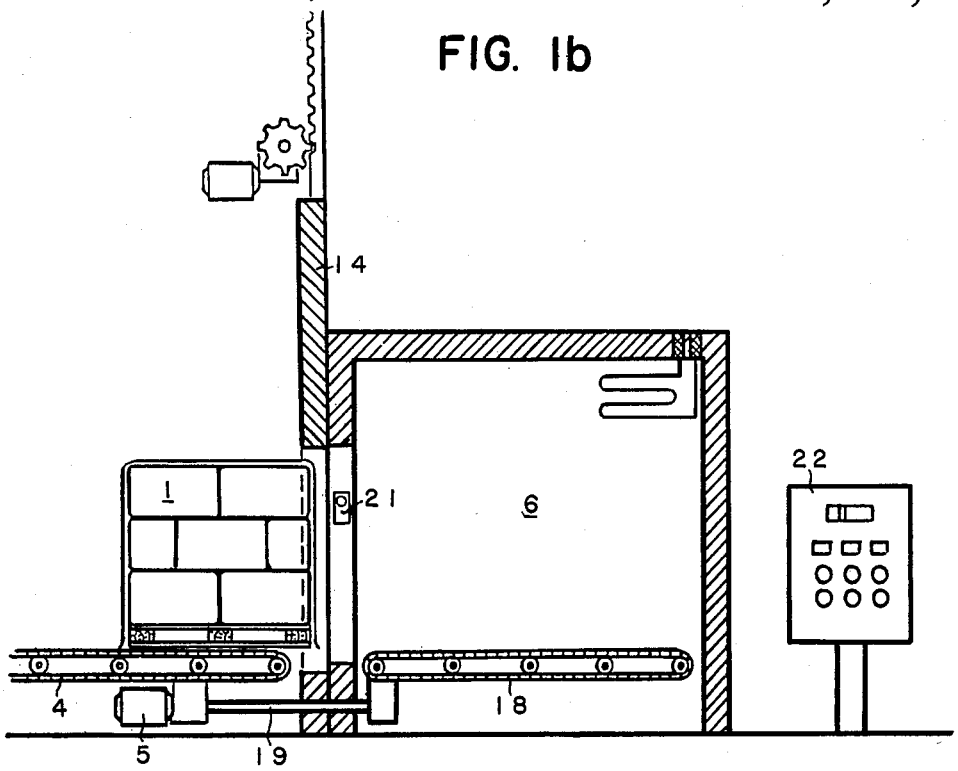
Figure 1C:
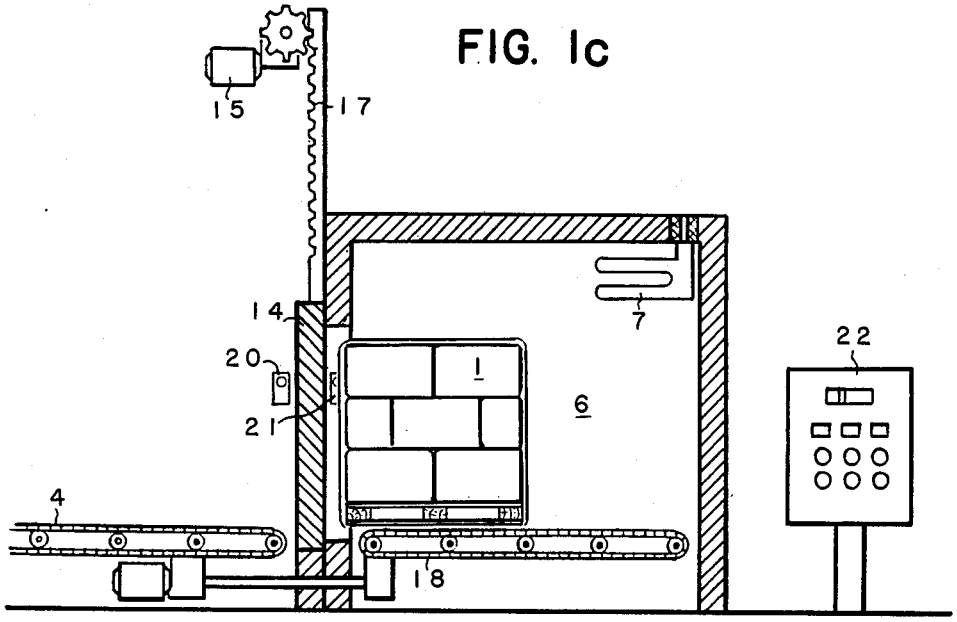
Figure 1D:
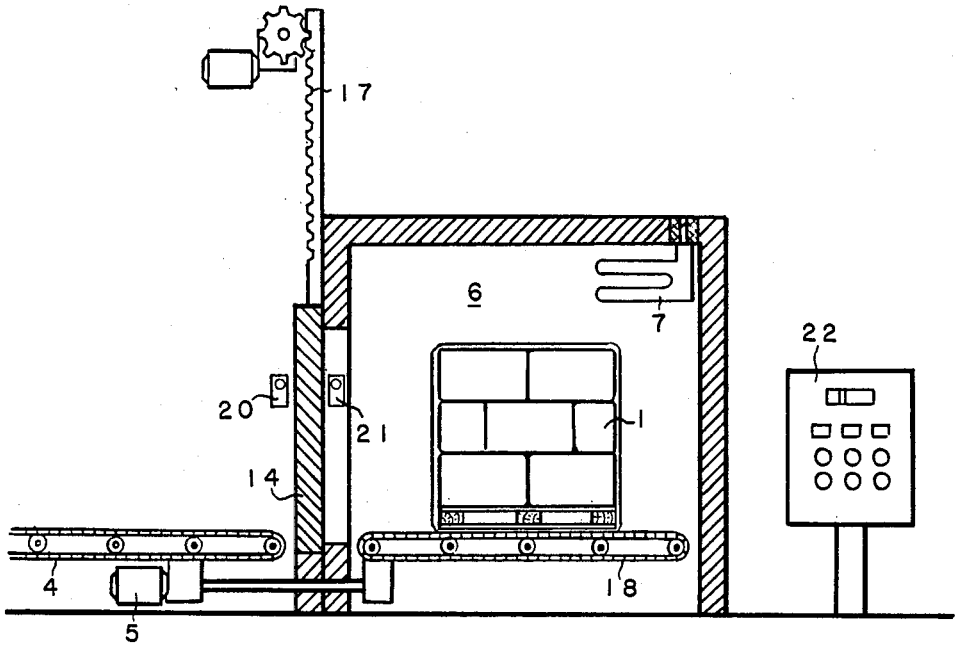

FIGS. 2 and 2*a* are views similar to FIG. 1 of an oven with a movable top that moves in synchronism with the load;

Structure, FIGS. 1–1*d*

Referring to FIG. 1, the load is stacked onto pallet 2 and covered by loosely fitting heat shrinkable bag 3. Conveyor 4 driven by motor 5 brings the load to the oven 6. The opening to the oven is preferably closely sized to the size of the front profile of the pallet load. Sliding oven door 14 is opened and closed by motor 15 driving pinion 16 and rack 17. Inside the oven, the load is moved by conveyor 18 driven by shaft 19 in synchronism with outside conveyor 4. Electric eyes 20 and 21 are positioned to detect the load 1 when it approaches the door 14 from the outside or from the inside, respectively. Controller 22 is adapted to be preprogrammed to regulate heating means 7 to control the temperature inside the oven and to actuate all motors in sequence and can be set to vary their speed and dwell time.

Operation

The pallet 2 bearing the load 1 covered by a loosely fitting heat shrinkable bag 3 is placed on the conveyor 4 by a forklift truck or some other means (not shown). Pushing the start button on the controller 22 activates motor 5 and the conveyor 4 carries the load 1 towards the oven 6. When the load 1 is in close proximity to the oven door 14, electric eye 20 signals the controller to stop the conveyor motor 5 at the position of FIG. 1, and to activate the motor 15 driving pinion 16 and rack 17 to raise the sliding door 14 to a height preset in relation to the height of the load 1, see FIG. 1*a*. As a result of positioning the pallet load in close proximity to the door opening, the load blocks the escape of heat from the oven as the door is being opened. The controller then actuates motor 5, moving the load 1 into the oven, first by conveyor 4, FIG. 1*b*, and then by conveyor 18.

Electric eye 21 monitors the passage of the load into the oven and as soon as the load is completely inside the oven, with the trailing edge of the pallet load at electric eye 21, it signals the controller to stop the load. Subsequently the sliding oven door closes, FIG. 1*c*. Again, as a result of stopping the load in close proximity to the door opening, the load blocks the escape of heat from the oven while the door is being closed.

As soon as the door is closed, conveyor 18 moves the load to the center of the oven, FIG. 1*d*, to initiate the heating cycle. The load remains in the center of the oven for the predetermined period of time necessary to heat bag 3 to the temperature at which it shrinks. In response to the controller, the load is then moved close to the door, the load stops, the door opens while loss of heated air is blocked by the load, and the load starts moving out of the oven. When electric eye 20 senses that the load is fully out of the oven it signals the controller to stop the load, and close the door. Again, as a result of stopping the load in close proximity to the door opening, the load blocks the escape of heat from the oven while the door is closed.

Once the doors close, the load is removed by the conveyor and the whole cycle can be repeated with a new load.

When introducing the load to the oven, one can achieve centering by means for measuring the length of the pallet as it moves past photocell 20, and provide a program for the interior conveyor 18 to move the desired amount taking into account the overall length of the oven.

A similar approach may be employed to achieve all controlled positions using one photocell located outside the oven at 20. If the pallet length is the same all the time, then photocell 20 detects the presence of the pallet and stops the conveyor. Then, after the door is opened, the appropriate program of the controller can move the conveyors the preset amount plus the width of the door to the second blocking position. After the door is closed a further part of the program may move the interior conveyor again a preset amount to center the pallet within the oven.

To also accommodate pallets of varying lengths, the photocell and controller may be arranged to detect the length of the pallet as it passes and cause the controller to adjust the lengths of travel of the various steps accordingly.

Figure 2:
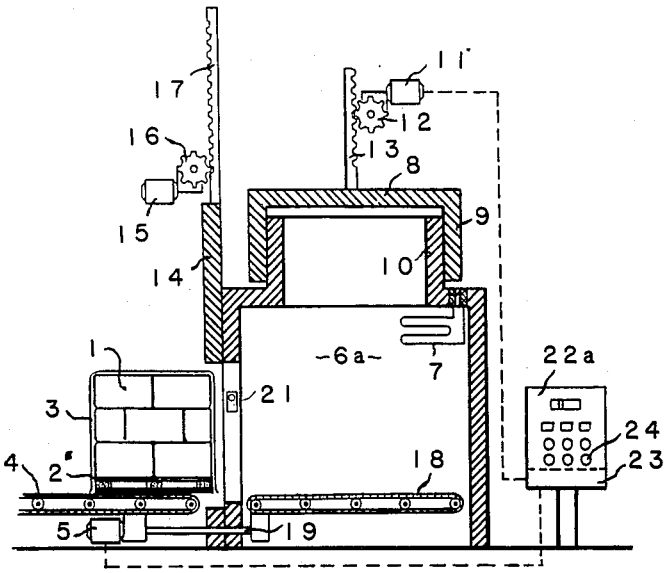
Figure 2A:
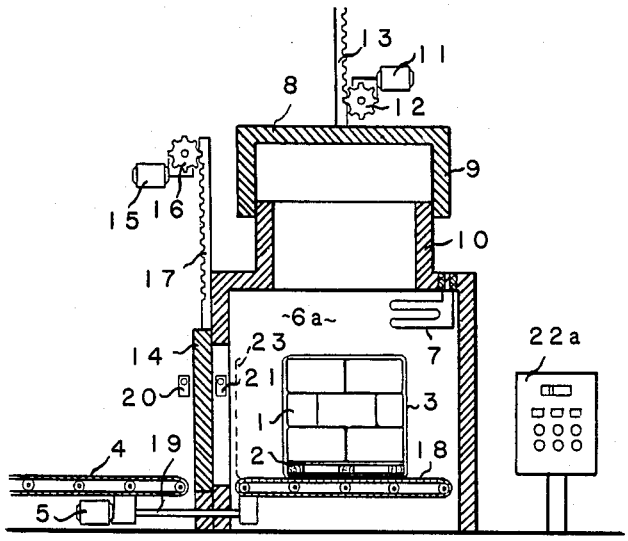

Structure FIGS. 2, 2*a*

Referring to FIGS. 2 and 2*a* oven 6*a* here has a movable top 8 fashioned as a cap with side walls 9 on all four sides that maintain an airtight sliding seal with oven walls 10 when raised and lowered by motor 11 driving pinion 12 and rack 13. In this case controller 22*a* includes a proportioned speed controller 23 having an input 24 for enabling preselection of the speed ratio between motors 5 and 11.

During movement of the load into the oven, as shown in FIG. 2, motor 11 is activated simultaneously raising the oven top 8 by means of pinion 12 and rack 13. The relative speeds of the load and the oven top are preadjusted by the speed control setting 24 of the controller in inverse proportion to the plan area ratios of the pallet load and the oven top such that the volume of air displaced by the entry of the load equals the interior volume increase of the oven due to elevating the oven top. As a result, there is no air lost out of the oven as the load enters.

When eye 21 detects that the load is completely inside the oven, the controller stops the load and simultaneously stops the raising of the top 9, in the position shown in FIG. 2*a*.

When the load starts moving out of the oven and the oven top is lowered simultaneously, again at the set speed ratio, thus decreasing the volume of the oven to compensate for the loss of load volume. As a result, no cold air rushes into the oven while the load is leaving.

In lieu of the sliding seal between top 8 and side walls 9, a connecting bellows may be employed.

Figure 3:
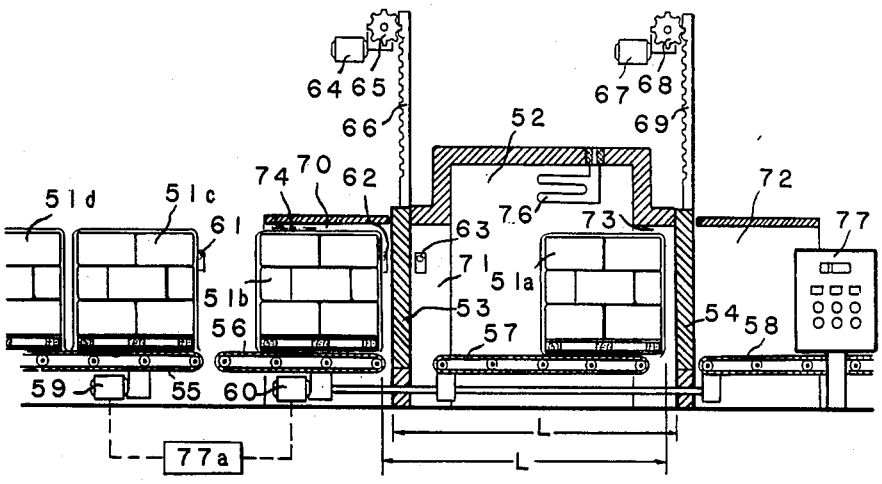
FIG. 3 is a front view partially in section of another embodiment which has a flow-through arrangement, one load being shown within the oven while the other load is ready to be charged.
Figure 4:
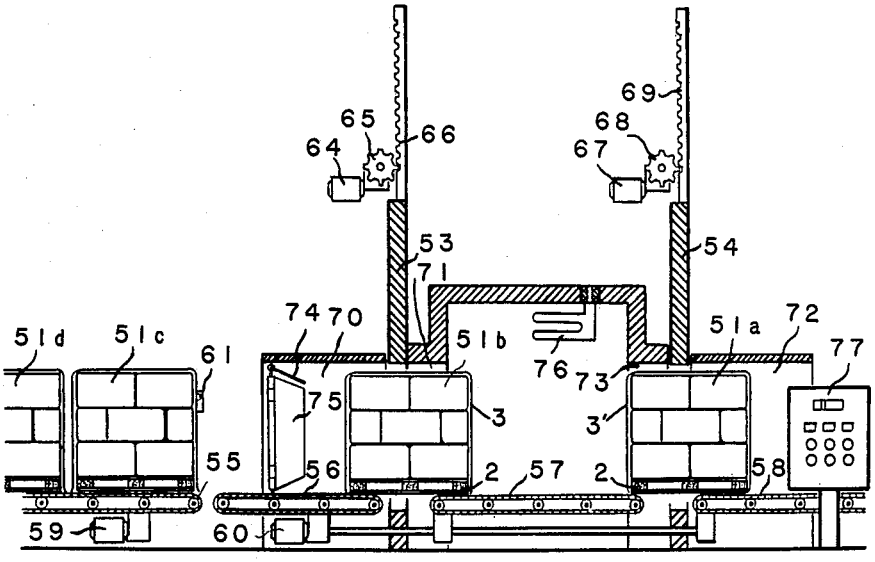
FIG. 4 is the same view as FIG. 3 showing the first load leaving the oven while the second load is entering.

Structure, FIGS. 3–4

Referring now to the embodiment of FIGS. 3 and 4 successive pallet loads 51*a*, 51*b* and 51*c*enter oven 52 through incoming door 53 and exit the oven through outgoing door 54. Two conveyor systems consisting of conveyor 55 and coupled conveyors 56, 57, and 58 are driven by motors 59 and 60 respectively in such a manner that incoming pallets are first brought to a halt at the end of conveyor 55 and then picked up by conveyor 56 to achieve an even spacing L between the front faces of successive pallet loads that corresponds exactly to the spacing between oven doors 53 and 54. Electric eyes 61, 62 and 63 are located at the end of conveyor 55, ahead of the door 53 and behind the door 53 respectively. Sliding doors 53 and 54 are opened and closed in unison by motors 64 and 67 driving pinion and rack sets 65, 66 and 68, 69, respectively. Ante-chamber 70 is located ahead of the incoming door 53 and is sized to accommodate the largest pallet load in a tight fit in height and width, thus to serve as a shroud to limit the air conductance at the gaps about the load. Another chamber 71 of similar dimensions is situated between the door and the oven interior. Corresponding chambers 72 and 73 are situated at the exit end. Spring-loaded, hinged top flap 74 and side flaps 75 (one shown) are located inside chamber 70 to take up the gap between the pallet load and the chamber walls for smaller loads. A suitable heating system is provided, schematically denoted by heating element 76. Controller 77 is adapted to be preprogrammed to regulate the temperature inside the oven and to actuate all motors in sequence and can be set to vary their speed and dwell time.

Operation

Pallet load 51*b* stacked on a pallet 2 and covered by loosely fitting heat shrinkable bag 3 is transported by conveyor 56 through the ante-chamber 70, pushing past the springloaded flaps 74, 75. Coupled conveyor 57 simultaneously transports pallet load 51*a* stacked on pallet 2 and covered tightly by heat shrink bag 3' from the center of the oven through chamber 73. When the front faces of the two pallets (which are spaced a distance L apart that corresponds exactly to the spacing between the two doors) are in close proximity to the oven doors 53 and 54 respectively, electric eye 62 signals the controller to stop the conveyor motor 60, open the doors (with motors 64 and 67, driving pinions 65 and 68 and racks 66 and 69) to a height preset in relation to the height of the loads. As a result of the tight fit between the sides of the loads and the walls of chambers 71 and 73 as well as the close proximity between the loads and the door openings, the loads block the escape of heat from the oven as the doors are being opened.

Once the doors are open the controller starts conveyors 56, 57 and 58 to transport load 51*a* out and load 51*b* into the oven. The controller also starts conveyor 55 during this phase to place load 51*c* onto conveyor 56 at the right time to achieve the correct spacing. As soon as electric eye 61 detects that load 51*d* following load 51*c* arrives in position, it signals the controller to stop conveyor 55. By virtue of the synchronized entry and exit of the two loads the rate of displacement of oven air volume by the entering load equals the rate of oven volume being left vacant by the leaving load, thus keeping the hot air volume of the oven constant. When electric eye 63 senses that load 51*b* is completely inside (and load 51*a* completely outside) the oven, it signals the controller to stop conveyors 56, 57 and 58 and close the doors. Again, due to the restricted gaps between the walls of the loads and the walls of extended chambers 71 and 73, which provide a labyrinth air-seal effect, as well as due to the close proximity of the faces of the loads to the doors, escape of hot air from the oven is minimized while the doors are being closed.

As soon as the doors are closed, conveyor 57 moves load 51*b* to the center of the oven to initiate the heating cycle. The load remains in the center of the oven for the predetermined period of time necessary to heat the bag 3 on load 51*b* to the temperature at which it will shrink, the load is moved out and the cycle is ready to be repeated with another load.

There are a number of ways by which spacing L between successive pallet loads may be achieved. In the arrangement shown in FIGS. 3 and 4, conveyor 55 is started to advance pallet 51*c* at the time the front face of pallet load 51*b* reaches distance L from the front face of pallet load 51*c* as determined by counter and control circuit 77*a*. If on the other hand, the distance between electric eyes 61 and 62 is made equal to distance L, then arrival of pallet at eye 62 can "lock" the drive motors 59 and 60 together, for mutual motion until pallet load 51*c* is transferred from conveyor 55 to conveyor 56. In still another arrangement, the conveyors 56 and 57 can be independently driven, but arrival of respective loads at the stop positions at the two doors (e.g. as detected by electric eyes) can, through the action of the controller 77, interlock the conveyors to advance in unison by one pallet width, again causing one load to enter the oven simultaneously with exit of the preceding load.

The invention is useful with radiation as well as convection ovens, and its manner of specific implementation can vary, e.g. in the case of retrofit applications. It should be noted that existing through-flow ovens can be readily modified to practice the invention.

I claim:

1. A shrink oven for heating and shrinking, in a shrink cycle, plastic film disposed about a load, said oven having an exterior, an interior and at least one opening for entry or exit of the load from the interior of said oven, a closure for said opening and conveyor means for conveying said load through the opening between the exterior and the interior of said oven, said oven characterized in having first load position control means operable when said load approaches said opening with said closure closed for stopping said conveyor means to position said load immediately preceding said closure, in a first blocking position to block flow of heat air out of said oven to the exterior, means operable while said load is in said first blocking position to open said closure, second position control means operable when said load passes through said opening for stopping said conveyor means after said load transits said opening to position said load immediately following said opening in a second blocking position to block flow of heated air out of said oven to the exterior, and means operable while said load is in said second blocking position to close said closure thereby to conserve energy during movement of the load between the exterior and the interior of said oven and to enable improvement in the shrink cycle.

2. The shrink oven of claim 1 wherein said conveyors are adapted to introduce said load into said oven and further characterized in having means operative when said load is within said oven to convey said load from said second blocking position to a heating position spaced further from said closure.

3. The shrink oven of claim 1 or 2 defining an interior volume and arranged to remove said load from said oven characterized in having movable means for decreasing the interior volume within one region of the oven for displacing heated oven air to fill the air space left behind said load as it exits the oven, a drive for said movable means, and synchronizing means for causing said movable means to move in a manner interdependently with movement of said load, thereby to limit inward flow of air during exit of the load from said oven.

4. The shrink oven of claim 1 or 2 in which a said opening to said oven is associated with means limiting air flow past the sides of said load.

5. The shrink oven of claim 4 including shroud means both inside and outside of said oven at said opening, adapted to limit the flow of air past said load when said closure is open.

6. A shrink oven for heating and shrinking, in a shrink cycle, plastic film disposed about a load, said oven having an exterior, an interior and at least one opening for entry or exit of the load from the interior of said oven, a closure for said opening and conveyor means for conveying said load through the opening between the exterior and the interior of said oven, said oven defining an interior volume and being arranged to remove said load from said oven; characterized in having first load position control means operable when said load approaches said opening with said closure closed for stopping said conveyor means to position said load immediately preceding said closure, in a first blocking position to block flow of heat air out of said oven to the exterior, means operable while said load is in said first blocking position to open said closure, second position control means operable when said load passes through said opening for stopping said conveyor means after said load transits said opening to position said load immediately following said opening in a second blocking position to block flow of heated air out of said oven to the exterior, and means operable while said load is in said second blocking position to close said closure thereby to conserve energy during movement of the load between the exterior and said oven and to enable improvement in the shrink cycle, and said oven having movable means for decreasing the internal volume within one region of the oven for displacing heated oven air to fill the air space left behind said load as it exits the oven, a drive for said movable means, and synchronizing means for causing said movable means to move in a manner interdependently with movement of said load, thereby to limit inward flow of air during exit of the load from said oven, said movable means being a movable oven boundary surface arranged to decrease the enclosed volume of said oven in relation to the rate of increase of air volume in said oven left by said leaving load, said boundary surface being driven in a manner dependent upon movement of said load.

* * * * *